United States Patent [19]

Schröter

[11] 3,956,974

[45] May 18, 1976

[54] DEVICE FOR BREAKING OUT SCRAP PIECES FROM A PUNCHED SHEET

[76] Inventor: Friedrich Schröter, 3004 Isernhagen NB-Sud, AM Waldchem 8, Germany

[22] Filed: Apr. 26, 1974

[21] Appl. No.: 464,521

[52] U.S. Cl. ..... 93/36 A; 83/103

[51] Int. Cl.[2] ..... B26D 7/18

[58] Field of Search ..... 93/36 A, 36 R, 59 ES; 83/103

[56] References Cited

UNITED STATES PATENTS

| | | | |
|---|---|---|---|
| 3,266,388 | 8/1966 | Jones | 93/36 A |
| 3,320,864 | 5/1967 | Zernov | 93/36 A |
| 3,371,584 | 3/1968 | Zernov | 93/36 A |
| 3,513,756 | 5/1970 | Schutz | 93/36 A |
| 3,524,364 | 8/1970 | Bishop | 93/36 A X |
| 3,575,091 | 4/1971 | LaBantshnig | 93/36 A |

*Primary Examiner*—James F. Coan

[57] ABSTRACT

An apparatus for breaking out or separating scrap pieces from a continuously moving sheet of material, such as paper or cardboard, having a die-cut or punched pattern therein is disclosed. The apparatus includes a pair of counter-rotating cylinder elements between which the sheet moves. One of such cylindrical elements carries at least one tool assembly having a radially displaceable tool element. The cylindrical elements are further mounted at a distance from each other less than the combined radii thereof, including the tool element, and preferably with the tool carrying cylindrical element displaced toward the direction of advancement of the sheet during separation. The radially displaceable tool element cooperates with the remaining cylindrical element to grip scrap pieces on both sides thereof and effect a gripped displacement laterally of the remainder of the sheet to separate the scrap pieces. The location of the tool assembly can be varied over the width of the sheet and around the periphery of the cylindrical element.

4 Claims, 4 Drawing Figures

DEVICE FOR BREAKING OUT SCRAP PIECES FROM A PUNCHED SHEET

BACKGROUND OF THE INVENTION

The invention covers a device for breaking-out scrap pieces during punching of material in sheet or web form, such as paper, cardboard or similar material, by means of two counter-rotating rolls, the lower of which is a smooth cylinder, while the upper is equipped with breaking-out tools and is displaced relative to the lower cylinder in the direction in which the material is advancing.

Such devices are designed to remove scrap pieces of different size and configuration created during the punching of folding boxes or similar items from the sheet or web of material. These scraps are connected to the workpiece by single fibres of material and by scrap bridges created at the impact points of the punching tool. Force must therefore be brought to bear on the scraps to separate the bridges during breaking-out operations.

To date, breaking-out of scrap by rotating devices has been accomplished primarily by picking up the scrap pieces with needles (DT-AS 1,511,048 and many others). It has also been suggested that scrap pieces may be held back and removed from the sheet material with the application of a partial vacuum (DT-AS 1,144,576). Additionally, a device is known in which the top roll is equipped with breaking-out projections which can be compressed in a longitudinal direction. The top roll runs on a plane different from that of the lower roll and vertical to the direction of movement of the material, so that the scrap pieces to be broken out come in contact with successive breaking-out projections staggered over the periphery of the top roll (DT-OS 1,611,617).

All these prior devices serve their purpose provided that the scrap pieces are sufficiently large to be subject to the intended effect. All known prior art devices, however, fail as soon as the scrap pieces are small, e.g., a circular surface of 5 millimeters in diameter or strips of 4 millimeters in width. Picking up the scrap pieces with needles will result in interruptions of the breaking-out process when the single scraps are so small that penetration of the needle causes the material to burst and thus the scraps can no longer be firmly held and removed. The vacuum approach, which can only be a partial vacuum, does not have sufficient holding power for small scraps to ensure a smooth removal of the pieces. Besides, these two devices are not well suited for breaking-out larger scrap pieces, which show a certain resistance to deflection, such as pieces of strong cardboard or corrugated board. A special device has been designed for this purpose, according to DT-OS 1,611,617. However, it fails to securely clamp the scrap pieces at the beginning of the breaking-out process and thus is unable to smoothly remove the smaller scraps too.

However, the breaking-out of small or long, narrow scraps is of the highest importance economically, as similar scraps are produced in large numbers during punching of folding boxes, and their reliable removal is decisive for the profitability of the entire punching operation.

The present invention solves this problem by making the distance between the centers of the cylindrical elements or rolls smaller than the sum of the radii of said rolls including the radial distance of the tool assembly in the outer rest position of the break-out tool. The tool assemblies are designed for radial spring action of a scrap engaging tool element in a way which is basically already known.

This construction of the cylindrical rolls results in the scrap pieces being securely held proximate the contact point of the material web with the lower roll, and in the scrap pieces being clamped between the radially springing breaking-out tool and the lower roll. There is no opportunity for evasion of even the smallest piece of scrap.

For the effects of this invention it is preferable to mount the radially springing or compressible break-out tools for adjustment in a peripheral or circumferential direction about the top cylindrical element or roll on disks, which also can be adjusted in an axial direction and are easily exchanged.

This form of construction permits presetting of the break-out tools in accordance with the different locations, shapes and configurations of the scrap pieces.

To transport the work pieces from the breaking-out device and evenly guide them during the breaking-out operation, it is advisable to mount rollers between the disks forming the rolls and carrying the break-out tools. These rollers engage and press the work pieces still remaining in the material plane against the lower roll.

It is further preferable to form the lower roll of easily exchanged cylinder sections, between which bars are adjustably mounted for movement in the direction of the roll axis and tangential to the circumference of the roll.

These bars feed the sheets of material or sections of web tangentially against the lower roll and serve as support for the work pieces remaining on the working surface during breaking-out operations.

An important additional feature of the device of the present invention consists in providing the shafts of the breaking-out device in the punching machine with graded scales and further to provide a separate tool presetting device with a similarly graded scale. This makes it unnecessary to tie up the punching machine for adjustments or resetting of the breaking-out device for new patterns. The disks with the breaking-out tools can, with the aid of these graded scales, be mounted on the upper shaft, and the cylinder sections can be mounted on the lower shaft in a very short period of time and in the exact same position that the breaking-out tools and cylinder sections had assumed in the presetting device.

The present invention offers the following advantages: scrap pieces of all sizes, especially those of very small size, are smoothly broken out by means of the rotating breaking-out device, of the present invention. The apparatus is further distinguished by its simple drive mechanism, a low encumbrance and its suitability for high material speeds. Furthermore, it is not necessary for the sheet of material or web to be stopped for the breaking-out operation. The break-out tools are simple and can be mounted closely to each other; they are universally applicable to various bolster plates. The device does not require the making of special parts to accomodate the changing form and configuration of the scrap pieces. The sets of tools can be preset in a separate device and mounted in the breaking-out device in a very short time.

DESCRIPTION OF THE DRAWINGS

In the following, one embodiment of said invention is described, making reference to the drawings.

DESCRIPTION OF PREFERRED EMBODIMENT

Figure 1:
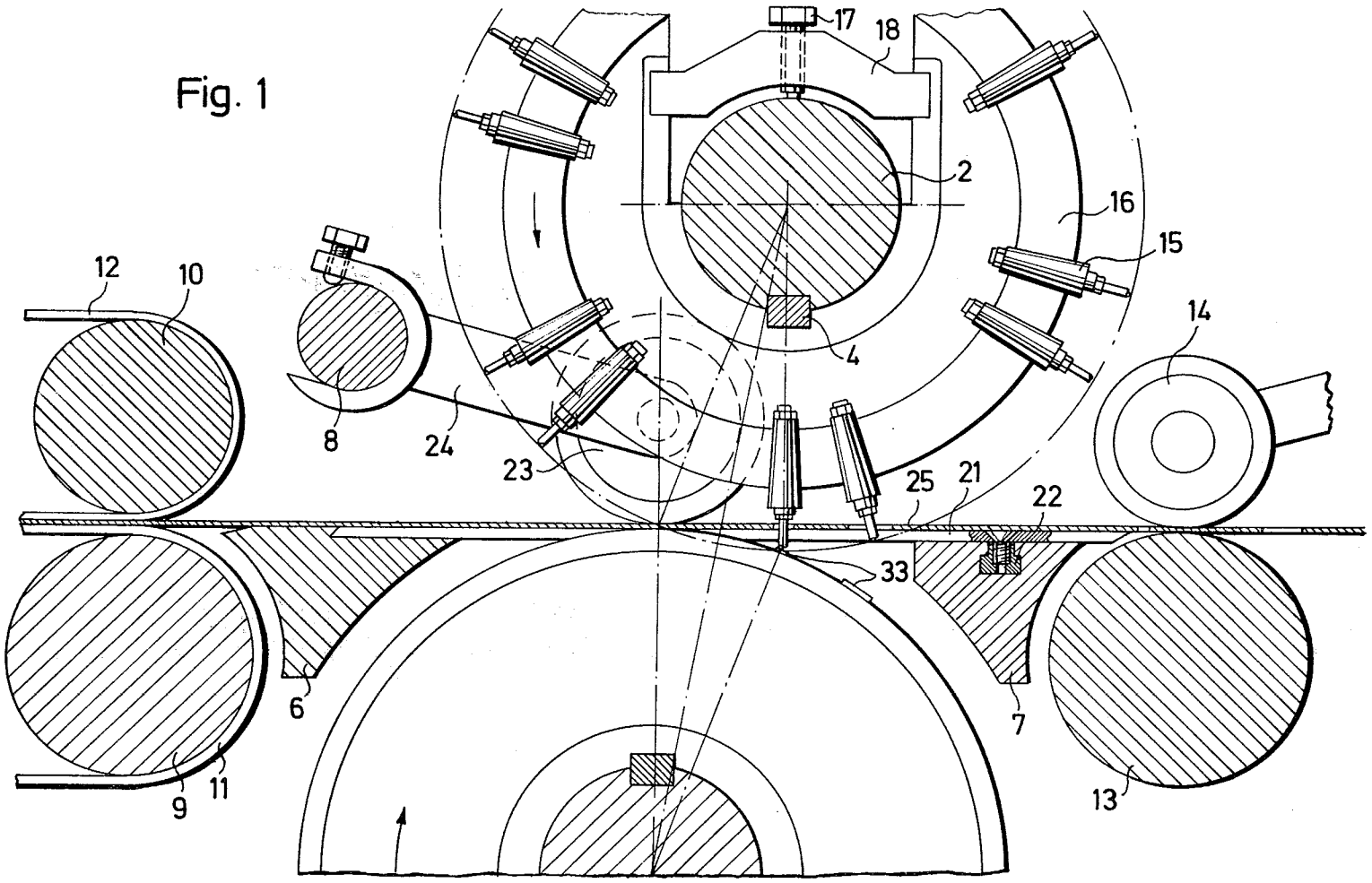
FIG. 1 is a fragmentary, side elevational view, in a cross-section, through a device constructed in accordance with the present invention.
Figure 2:
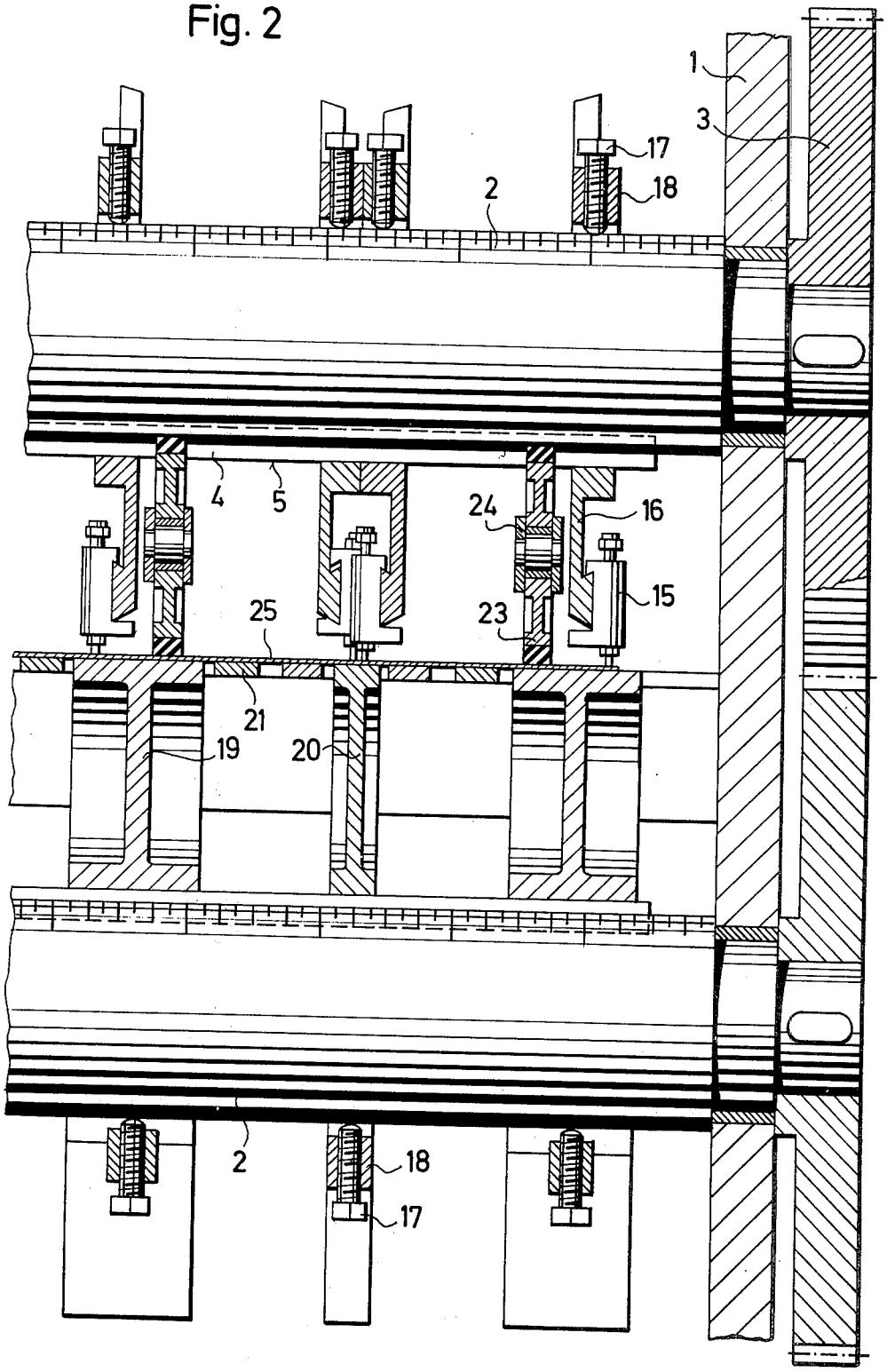
FIG. 2 is fragmentary, end elevation view, in cross-section, of one side of the apparatus of FIG. 1.

The device consists of a frame 1, rotating shafts 2, and upper and lower gears 3 engaging each other and being driven by the upper and lower punching machine through a driving gear not shown here. Each shaft 2 bears a feather key 4, the back of which has a graded scale 5. Two supports 6 and 7 are mounted to extend parallel to shafts 2 in frame 1, and also, an axle 8.

In the direction in which the material advances, two cylinders 9 and 10 are mounted in frame 1 ahead of the scrap breaking-out apparatus. These cylinders, together with conveyor belts 11 and 12, advance the punched material or web into the breaking-out apparatus. After the breaking-out device follows a cylinder 13 with pressure rollers 14 for further transport of the work pieces, now free of scraps. Parts 2–14 remain in the machine even when the punching pattern is changed. The following parts make up the set of tools which is exchanged or newly set when the punching pattern changes.

Breaking-out tool assemblies 15, whose structure and function are explained later on are mounted on disks 16 and can be adjusted in a peripheral direction about such disks. Disks 16, which form the upper or first cylindrical element, have central openings which extend to a side of the disks, and can therefore be slid onto the upper shaft 2 by moving the disks transversely of the axis of shaft 2, at which point the disks can be clamped in place with screws 17 passing through laterally inserted gripping elements 18. With this construction, a breaking-out tool assembly 15 can be adjusted along shaft 2 and peripherally around disks 16 set the tools at any given point on a sheet of material or section of web.

The lower or second cylindrical element is formed by cylindrical sections 19 and 20 which have the same kind of openings as disks 16 and, like disks 16, cylindrical sections 19 and 20 can be slid onto the lower shaft 2, transversally to the axis of shaft 2, and clamped in place with screws 17 and gripping elements 18. The cylinder sections 19 and 20 can be combined according to the size of the work piece to roll-sections of varying width, and they are easily exchanged.

Bars 21, guided by the supports 6 and 7, can be adjusted over the width of the device, and are also easily exchanged. They are held in place by means of sliding blocks 22, which slide in a T-groove of support 7.

Pressure rollers 23 are mounted with their supports 24 on axle 8 and can be adjusted crosswise to the device.

Figure 3:
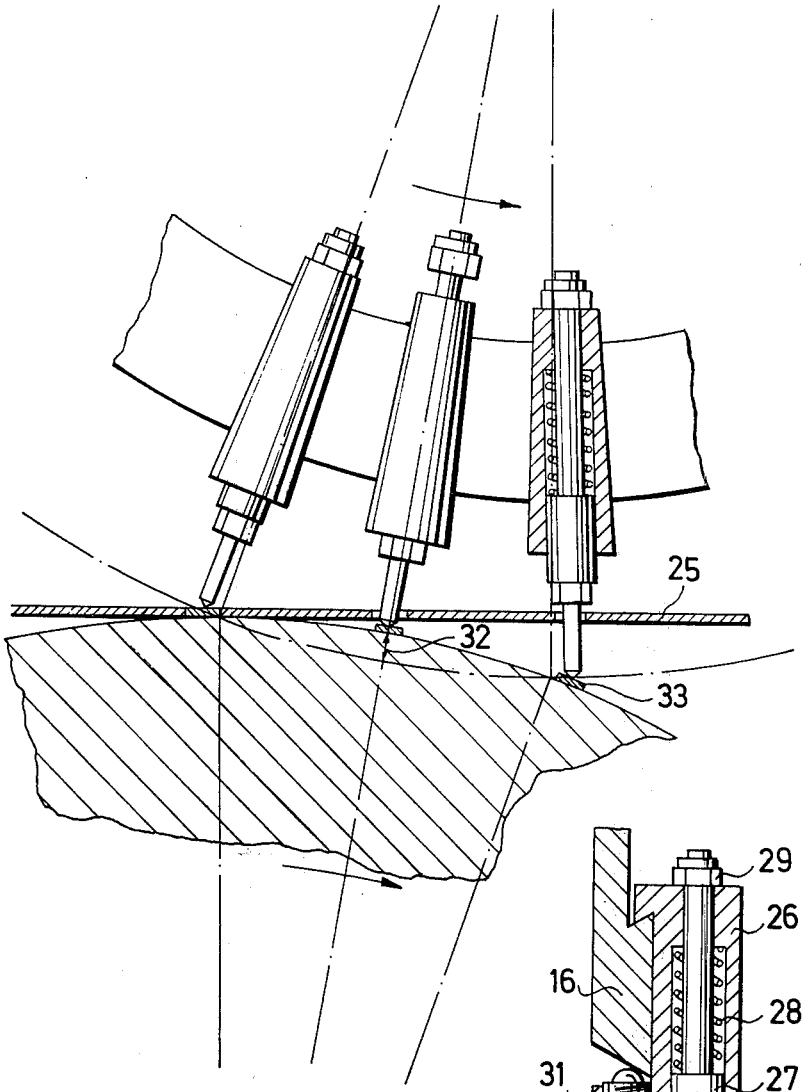
FIG. 3 is an enlarged, fragmentary, side elevational view, partially in cross-section showing the break-out tools in three phases of the breaking-out operation.
Figure 4:
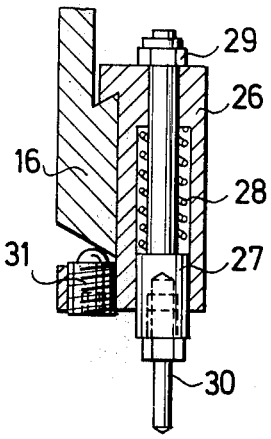
FIG. 4 is an enlarged, fragmentary, end elevational view, in cross-section of a breaking-out tool assembly of FIG. 3.

The breaking-out tools 15 consist, as best may be seen in FIGS. 3 and 4, of a housing 26, a slide 27 guided in housing 26, which is pressed radially towards the outside by a compression spring 28, a nut 29 limiting the radial path of said slide 27, and a removable or exchangeable pin or tool element 30, which could be replaced by a pin or tool element of any desired shape. The entire breaking-out tool assembly can be clamped to disk 16 with a screw 31.

The mode of operation of the device is as follows. Conveyor belts 11 and 12 in FIG. 1 feed in a sheet of material or a section of the web 25. As soon as the front edge has reached rollers 23, these rollers operate to further transport and evenly guide the web. Bars 21 support the work pieces during the breaking-out operation. The work pieces freed or liberated from the scraps are transported out of the device by cylinder 13 and pressure rollers 14.

The effectiveness of the break-out tools is based on the difference between the distance between the axes of the cylindrical element or rolls and the sum of their radii. This difference has been shown as path 32 in FIG. 3 in which a break-out tool is shown in 3 stages of the breaking-out process. Breaking-out starts at left when the tool element or pin 30 touches the scrap piece 33 resting on the lower roll. Upon further rotation, due to the difference of path 32, the effective radius of the top or first cylindrical element must be shortened by a radial movement of slide 27, with pin 30 held against piece 33 under the pressure of spring 28. During this operation, the scrap piece 33 is securely clamped between tool element 30 and the lower or second cylindrical element.

In the middle phase, the greatest shortening or radially inward displacement of tool element 30 occurs. During further rotation, the inward displacement of tool element 30 decreases to the position shown at the right of FIG. 3, in which the slide 27 with pin 30 resumes its outer position of rest. As will be noted, the radial distance between the center of first cylindrical element and the tool assemblies is greater than the radial distance normal to the sheet which causes the lateral separation of the scrap piece. Subsequent rotation of the cylindrical elements releases scrap piece 33 as pin 30 moves away from the lower cylindrical element.

It is possible to mount the tool assembly carrying first cylindrical element below the sheet of material and the second cylindrical element above the sheet of material, but the first cylindrical element should still be displaced relative to the second cylindrical element in the direction of advancement of the punched sheet. This construction, however, will cause gravitation of the scrap pieces back toward the sheet, which may be disadvantageous.

I claim:

1. In an apparatus for breaking-out scrap pieces from a sheet of material having a pattern punched therein, and including a frame, first and second cylindrical elements mounted to said frame for rotation in opposed relation and for passage of said sheet of material therebetween, and at least one break-out tool assembly mounted to and carried by said first cylindrical element, the improvement comprising:

said tool assembly including a radially displaceable tool element; and said cylindrical elements being further mounted to said frame at a distance from each other less than the sum of:

1. the radial distance from the center of said first cylindrical element to the distal end of said tool element in the radially extended position thereof, plus 2. the radius of said second cylindrical element, said distance between and the relative mounting of said cylindrical elements being selected to cause said distal end of said tool element to be forced into firm gripped engagement with said scrap pieces, regardless of the thickness of said scrap pieces, before lateral displacement of said pieces, and said cylindrical elements further being mounted for a cooperative gripped displacement of said scrap pieces laterally of said sheet of material after firm gripping of said scrap pieces upon rotation of said cylindrical elements.

2. An apparatus as defined in claim 1 wherein, said first cylindrical element includes at least one disk removably mounted thereto, said disk being further mounted for adjustment and positioning at selected locations over the width of said sheet of material, said tool assembly being mounted to said disk, and said disk and tool assembly being adapted for adjustment and positioning of said tool assembly at selected locations around the periphery of said disk.

3. In an apparatus for breaking-out scrap pieces from a sheet of material having a pattern punched therein, and including a frame, first and second cylindrical elements mounted to said frame for rotation in opposed relation and for passage of said sheet of material therebetween, and at least one break-out tool assembly mounted to and carried by said first cylindrical element, said tool assembly including a radially displaceable tool element formed for gripping and lateral displacement of scrap pieces in cooperation with said second cylindrical element, the improvement comprising:

said first cylindrical element includes a plurality of laterally spaced apart disks with each of said disks having at least one tool assembly mounted thereto; and at least one pressure roller formed for engagement of said sheet material intermediate said disks and disposed opposite to said second cylindrical element for pressure engagement of said sheet of material with said cylindrical element.

4. In an apparatus for breaking-out scrap pieces from a sheet of material having a pattern punched therein, and including a frame, first and second cylindrical elements mounted to said frame for rotation in opposed relation and for passage of said sheet of material therebetween, and at least one break-out tool assembly mounted to and carried by said first cylindrical element, said tool assembly including a radially displaceable tool element formed for gripping and lateral displacement of scrap pieces in cooperation with said second cylindrical element, the improvement comprising:

said first cylindrical element includes a plurality of cylindrical disks and second cylindrical element includes a plurality of cylinder sections, said disks and said sections being movably mounted to transversely extending shafts for lateral adjustment of said disks over the width of said sheet of material, said shafts each being formed with a graded scale extending along the length thereof to indicate the lateral position of each of said disks and sections, and support bars mounted for support of said sheet of material and extending along said sheet of material substantially tangentially of said second cylindrical element, said support bars being further mounted for selected lateral adjustment over the width of said sheet of material.

* * * * *